US010695636B2

(12) United States Patent
Mekonen

(10) Patent No.: US 10,695,636 B2
(45) Date of Patent: Jun. 30, 2020

(54) BALL GAME

(71) Applicant: Azezo Ltd, Netanya (IL)

(72) Inventor: Adisalem Mekonen, Netanya (IL)

(73) Assignee: AZEZO LTD., Netanya (IL)

( * ) Notice: Subject to any disclaimer, the term of this patent is extended or adjusted under 35 U.S.C. 154(b) by 0 days.

(21) Appl. No.: 16/300,980

(22) PCT Filed: May 16, 2017

(86) PCT No.: PCT/IB2017/052871
§ 371 (c)(1),
(2) Date: Nov. 13, 2018

(87) PCT Pub. No.: WO2017/199165
PCT Pub. Date: Nov. 23, 2017

(65) Prior Publication Data

US 2019/0151734 A1 May 23, 2019

Related U.S. Application Data

(60) Provisional application No. 62/337,905, filed on May 18, 2016.

(51) Int. Cl.

| | |
|---|---|
| ***A63B 67/10*** | (2006.01) |
| ***A63B 71/06*** | (2006.01) |
| ***A63B 67/00*** | (2006.01) |
| ***A63B 71/02*** | (2006.01) |

(52) U.S. Cl.
CPC ..... *A63B 67/10* (2013.01); *A63B 67/002* (2013.01); *A63B 71/023* (2013.01); *A63B 71/06* (2013.01); *A63B 71/0622* (2013.01); *A63B 2071/026* (2013.01); *A63B 2220/24* (2013.01); *A63B 2220/803* (2013.01); *A63B 2225/20* (2013.01); *A63B 2225/50* (2013.01)

(58) Field of Classification Search
CPC ..... A63B 69/0079–0088; A63B 2069/0082
USPC ..... 473/427, 429, 430
See application file for complete search history.

(56) References Cited

U.S. PATENT DOCUMENTS

| | | | | |
|---|---|---|---|---|
| 2,506,825 | A * | 5/1950 | Carlson | A63B 69/0079 235/103 |
| 5,228,683 | A * | 7/1993 | Beimel | A63B 69/0091 473/427 |
| 5,275,396 | A * | 1/1994 | Sudia | A63B 69/0091 473/427 |
| 5,454,561 | A * | 10/1995 | Smith | A63B 69/0079 473/140 |
| 5,588,655 | A * | 12/1996 | Slupskiy | A63B 69/0091 473/429 |
| 7,175,536 | B1 * | 2/2007 | Tortola | A63B 69/0002 473/140 |
| 2006/0035730 | A1 * | 2/2006 | Nguyen | A63B 69/0073 473/417 |
| 2009/0060473 | A1 * | 3/2009 | Kohte | F16M 11/041 386/200 |

(Continued)

*Primary Examiner* — Jeffrey S Vanderveen
(74) *Attorney, Agent, or Firm* — Mark M. Friedman

(57) ABSTRACT

A ball game including a vertically disposed rod, a holder for holding a handheld device, the holder being rotatably mounted on the rod such that the holder can be rotated about an axis of said rod; and a ball coupled to the holder by a string and configured such that rotation of the ball about the rod urges the rotation of the holder about the axis of the rod.

10 Claims, 3 Drawing Sheets

(56) References Cited

U.S. PATENT DOCUMENTS

| | | | | |
|---|---|---|---|---|
| 2013/0157785 | A1* | 6/2013 | Connors | A63B 69/0002 473/429 |
| 2015/0360107 | A1* | 12/2015 | Achkar | A63B 69/002 473/429 |
| 2016/0030826 | A1* | 2/2016 | Hymer | A63B 69/0002 473/430 |

* cited by examiner

BALL GAME

FIELD OF INVENTION

The presently disclosed subject matter relates to a ball game, in general, and in particular to a ball game integrated with a smart phone.

BACKGROUND

Ball games are well known for their advantages positive effect on a child's heart and lung. It helps children build better coordination and balance and create habits that contribute to children becoming healthy and active adults.

A ball game in general instills pride and sense of accomplishment as children set goals and work hard to achieve them and improves creative and strategic thinking as children learn the rules of the game and the best ways to play.

SUMMARY OF INVENTION

There is provided in accordance with an aspect of the presently disclosed subject matter a ball game including a vertically disposed rod, a holder for holding a handheld device, the holder being rotatably mounted on the rod such that the holder can be rotated about an axis of the rod; and a ball coupled to the holder by a string and configured such that rotation of the ball about the rod urges the rotation of the holder about the axis of the rod.

The holder can be configured such that in response to torque applied on the ball the holder is rotated about the rod.

The holder can further include solar panels configured to provide electric power to charge the handheld device.

The ball game can include a docketing station configured for coupling the handheld device thereto to provide the electric power from the solar panel to the handheld device.

The ball holder can be configured as a universal holder such that it can hold therein verity of handheld devices.

The holder can include a housing and two clips mounted therein and being configured for disposing the handheld device therebetween, wherein the distance between the clips can be set in accordance with the size of the handheld device.

There is provided in accordance with another aspect of the presently disclosed subject matter a combination of a ball game and software for controlling the ball game. The combination comprising: a vertically disposed rod, a holder for holding a handheld device, the holder being rotatably mounted on the rod such that the holder can be rotated about an axis of the rod; a ball coupled to the holder by a string and configured such that rotation of the ball about the rod urges the rotation of the holder about the axis of the rod; a software installed on a handheld device and being configured to detect rotational displacement of the holder.

The software is configured to receive date from a motion sensor of a handheld device mounted inside the holder regarding the motion of the handheld device when mounted inside the holder.

The software can be further configured to detect the rotational direction of the ball. The software can further be configured to detect the number of rotations of the ball about the rod, the speed of rotation and the direction of the rotation.

The software can be further configured to display on a handheld device number of number or rotations of the ball.

A combination of a game and software for controlling the game, the combination comprising:

There is provided in accordance with yet another aspect of the presently disclosed subject matter a movable member mounted on a stationary member and configured to be mountably displaceable with respect thereto;

a holder for holding a handheld device, the holder being mounted on the movable member and configured to be displaced therewith with respect to the stationary member;

a software installed on a handheld device and being configured to detect displacement of the holder.

BRIEF DESCRIPTION OF THE DRAWINGS

In order to understand the disclosure and to see how it may be carried out in practice, embodiments will now be described, by way of non-limiting examples only, with reference to the accompanying drawings, in which.

DETAILED DESCRIPTION OF EMBODIMENTS

Figure 1:
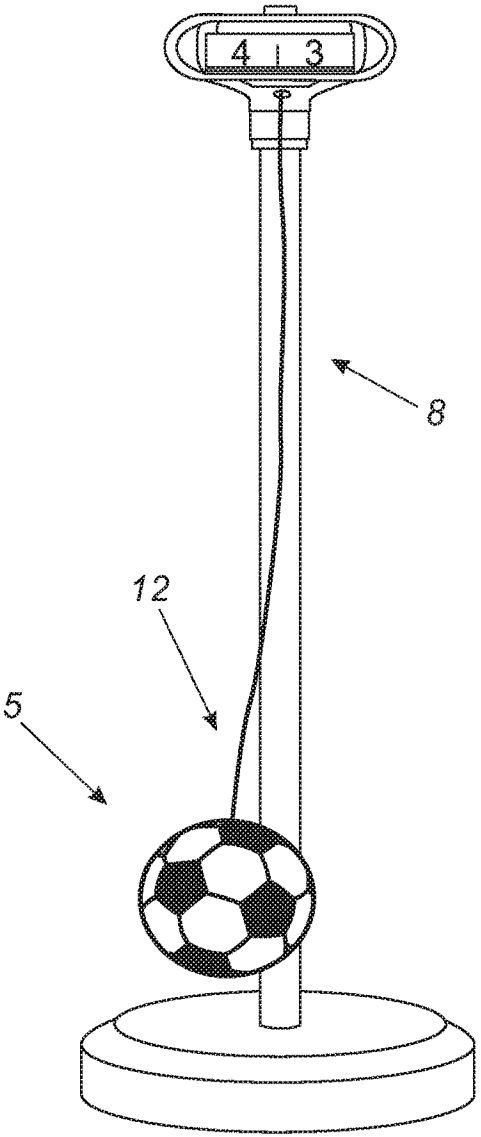
FIG. 1 is a perspective view of a ball game in accordance with an example of the presently disclosed subject matter.
Figure 2:
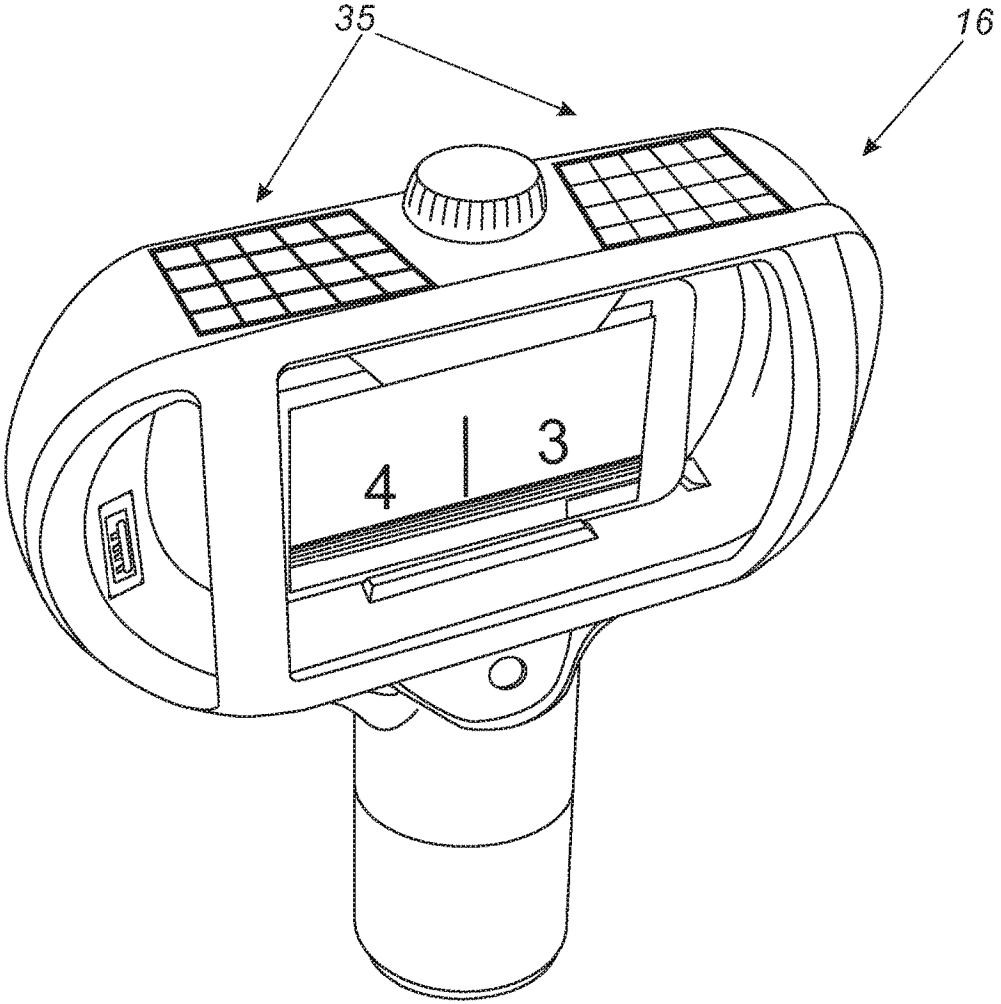
FIG. 2 is a close up perspective view of a holder of the ball game of FIG. 1.

FIGS. 1 and 2 shows a ball game having a holder 16 rotatably mounted on a rod 8 and a ball 5 coupled to the rotatable holder 16 by a string 12, such that when the ball 5 is hit the string 12 urges the ball to rotate about the rod. The holder 16 is configured such that in response to torque applied on the ball 5 the holder 16 is rotated about the rod 8.

The ball game can thus be used for a game in which a player is throwing the ball creating a torque and causing the ball 5 to rotate about the rod 8. The ball game can be used for two player throwing the ball towards one another and competing how many times each player was able to hit the ball.

Figure 3B:
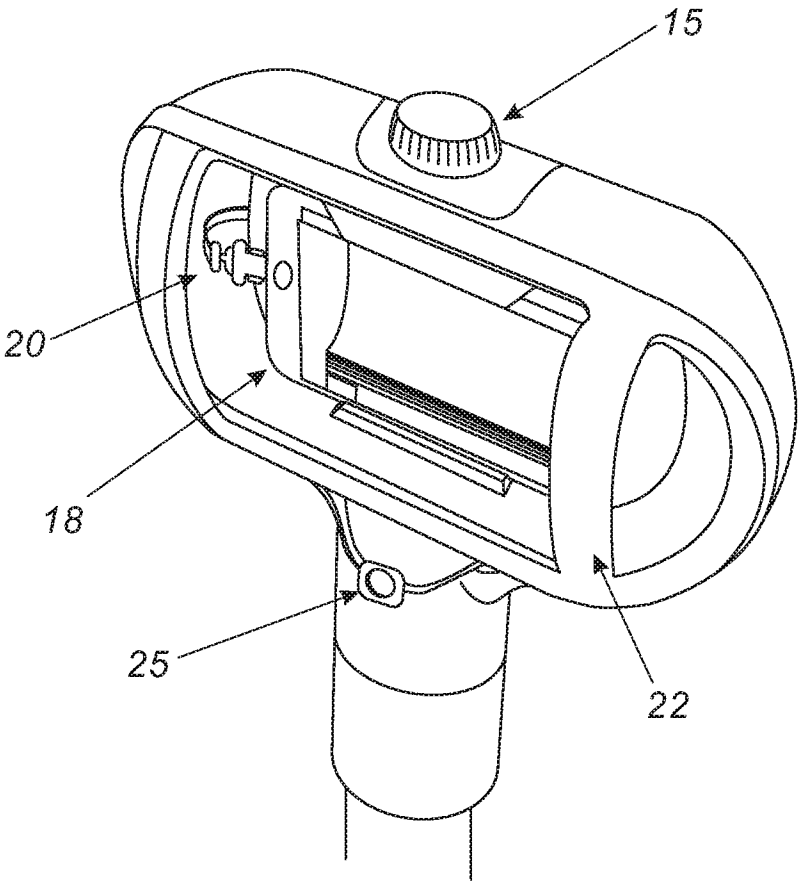
FIG. 3B is a schematic illustration of a second side of the holder of FIG. 2.
Figure 3A:
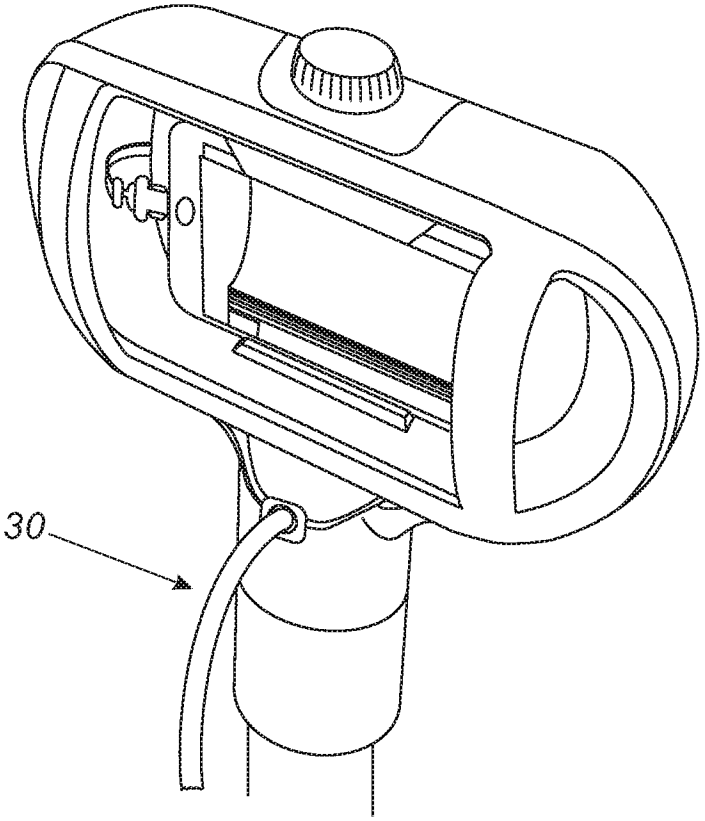
FIG. 3A is a schematic illustration of a first side of the holder of FIG. 2.
Figure 3C:
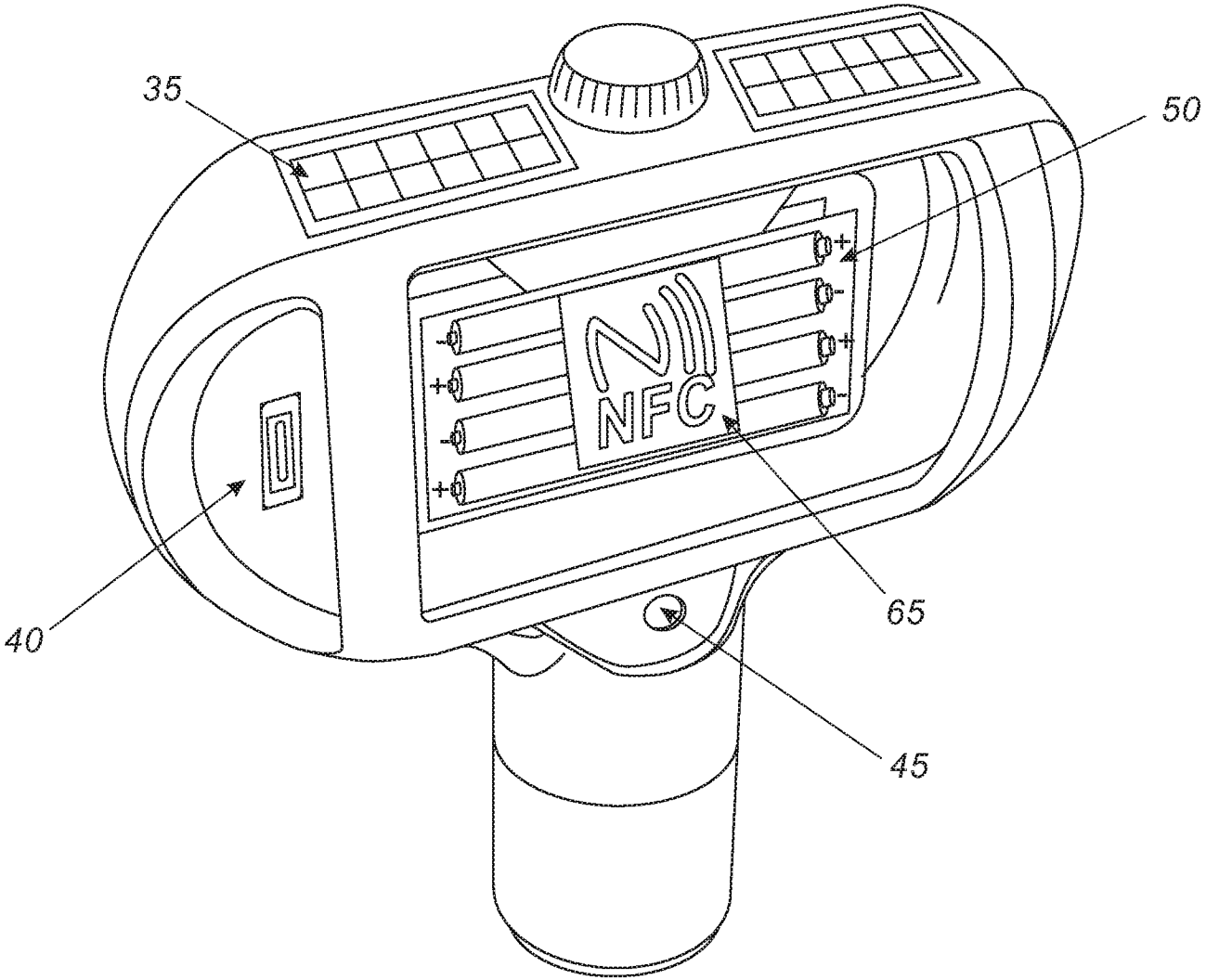
FIG. 3C is a front view schematic illustration of a second side of the holder of FIG. 2.

As shown in the FIGS. 3A to 3C, the holder is further configured to securely hold therein a handheld device 18, such as a cellular phone, iPod etc., provided with a software adapted for controlling the ball game, as described herein below. The handheld device can be configured to display the score 50 of the users on a display 65, for example how many hits of balls each user was able to make. More functionalities of the game are described hereinafter in length.

The holder can further includes solar panels 35, configured to provide electric power to charge the handheld device. As shown in FIGS. 3B and 3C, the holder can include a docketing station 40 or a plug 20 to which the handheld device is coupled so as to provide the electric power from the solar panel to the handheld device.

The holder 16 can be configured as a universal holder such that it can hold therein verity of handheld devices. According to an example the holder includes a housing and two clips mounted therein and being configured for disposing the handheld device therebetween. The distance between the clips can be set in accordance with the size of the handheld device. For example at least one of the clips can be coupled to an adjusting bolt 15 extending through a wall of the housing and having a screw thread. The bolt can be provided with a bolt head disposed on an outer surface of the housing and configured such that rotation thereof sets the disposition of the clip with respect to the opposing clip, such that the distance between the clips corresponds to the size of the handheld device.

The holder 16 can further includes a protector 22 disposed in front of the handheld device when the latter is mounted in the holder 16 and being configured such that the ball 5 does not accidently hit the handheld device.

The holder 16, is rotatably mounted on the rod 8, and is configured to rotate about the axis of the rod. The holder 16 includes a string coupler 30 for coupling the string 12 to the holder 16. This way, the holder rotates in response to the sting pulls in various direction about the axis of the rod, such that when the ball is hit the string and the ball urging the rotation of the holder. The string coupler can include a through-going bore 45 through which the string can be extended. The string can include a knot such that it remains fastened to the through-going bore 45

The rod 8 can be configured to be disposed on the floor or the ground, or alternatively can be configured to be disposed on a raised surface, such as a table.

As indicated hereinabove the handheld device is configured with a software such as an app, configured for controlling the ball game.

According to an example the application is configured for utilizing motion sensor of the handheld device, such as gyroscope. The application can thus receive data from the motion sensor regarding the motion of the handheld device when mounted inside the holder 16. This way, rotation of the holder, and hence the ball 5 can be detected. The application can further be configured to detect the rotational direction of the ball 5, i.e. clockwise or counterclockwise.

According to an example the application can be configured to detect the number of rotations of the ball about the rod 8, the speed of rotation and the direction of the rotation.

According to another example the application can detect when the ball is hit and thus the direction of rotation thereof is changed. This way the ball game can be such which encourage a user to reciprocally hit the ball to rotate about the rod in alternating directions. The display can be configured the number of hits or the number or rotations the user missed the ball.

According to a further example, the application can be configured for a two participant game, in which each participant stands on one side of the rod and the hit the ball back to the other participant in an alternating rotational direction. The application can thus be configured to detect the amount of hits of each participant, and display the same on a display.

At the start of the game the application is configured to detect the rotational location of each player about the rod 8. Each player can insert his name, and the application keeps record of how many hits each player has scored. When the ball is rotated over the location of the user, it is detected by the motion sensor of the handheld device, and it can be considered as a miss, since the player failed to push the ball back towards his opponent.

According to a further example the application is configured to provide guiding annotations, such as voice announcement guiding the player to hit the ball for example in a certain direction, or to perform any other action.

According to a further example the application, can be wirelessly coupled to a remote wearable device, such as an electronic bracelet, providing data regarding the motion of player, such as calories consumption etc.

The application is further configured to display data on the screen of the handheld device, or to transmit data to a remote display, such as Smart TV, iPad etc. For example, the application can make use of the Bluetooth transducer of the handheld device to transmit data regarding the game to a remote handheld device, or a display.

The application can further be configured to transmit data over the internet, such that a ball game can be played against remote participant. The application can display data regarding the other remote participants.

According to another example, there is provided another game including a movable member mounted on a stationary member, such as a boxing pillow mounted on the ceiling. The movable member is configured to be mountably displaceable with respect to the stationary member.

The game further includes a holder for holding a handheld device, the holder being mounted on the movable member and configured to be displaced therewith with respect to the stationary member. The game can further include a software installed on a handheld device and being configured to detect displacement of the holder.

Those skilled in the art to which the presently disclosed subject matter pertains will readily appreciate that numerous changes, variations, and modifications can be made without departing from the scope of the invention, mutatis mutandis.

The invention claimed is:

1. A ball game comprising:

a vertically disposed rod;

a holder for holding a handheld device having a housing and two clips mounted therein and being configured for disposing the handheld device therebetween, wherein the distance between the clips can be set in accordance with the size of the handheld device, said holder being rotatably mounted on said rod such that the holder can be rotated about an axis of said rod;

a ball coupled to said holder by a string and configured such that rotation of the ball about the rod urges the rotation of the holder about said axis of said rod.

2. The ball game of claim 1 wherein said holder is configured such that in response to torque applied on the ball the holder is rotated about the rod.

3. The ball game of claim 1 wherein said holder further includes solar panels configured to provide electric power to charge said handheld device.

4. The ball game of claim 3 include a docketing station configured for coupling said handheld device thereto to provide the electric power from said solar panel to the handheld device.

5. The ball game of claim 1 wherein said holder is configured as a universal holder such that it can hold therein variety of handheld devices.

6. A combination of a ball game and software for controlling said ball game, the combination comprising:

a vertically disposed rod;

a holder for holding a handheld device having a housing and two clips mounted therein and being configured for disposing the handheld device therebetween, wherein the distance between the clips can be set in accordance with the size of the handheld device, said holder being rotatably mounted on said rod such that the holder can be rotated about an axis of said rod;

a ball coupled to said holder by a string and configured such that rotation of the ball about the rod urges the rotation of the holder about said axis of said rod;

a software installed on a handheld device and being configured to detect rotational displacement of said holder.

7. The combination of claim 6 wherein said software is configured to receive data from a motion sensor of a handheld device mounted inside the holder regarding the motion of the handheld device when mounted inside the holder.

8. The combination of claim 7 wherein said software is further configured to detect the rotational direction of said ball.

9. The combination of claim 7 wherein said software is further configured to detect the number of rotations of the ball about the rod, the speed of rotation and the direction of the rotation.

10. The combination of claim 6 wherein said software is further configured to display on a handheld device the number of number or rotations of said ball.

* * * * *